United States Patent [19]

Kasai et al.

[11] Patent Number: 4,816,869

[45] Date of Patent: Mar. 28, 1989

[54] DEVELOPING APPARATUS FOR APPLYING DIFFERENT COLOR TONERS

[75] Inventors: Toshihiro Kasai; Tatsuya Tsujii, both of Yokohama, Japan

[73] Assignee: Kabushiki Kaisha Toshiba, Kawasaki, Japan

[21] Appl. No.: 101,002

[22] Filed: Sep. 25, 1987

[30] Foreign Application Priority Data

Sep. 29, 1986 [JP] Japan ..... 61-230706

[51] Int. Cl.[4] ..... G03G 15/00

[52] U.S. Cl. ..... 355/4; 355/300; 430/45

[58] Field of Search ..... 355/4, 3 DD, 14 D; 118/645; 430/45

[56] References Cited

U.S. PATENT DOCUMENTS

| | | | |
|---|---|---|---|
| 4,398,817 | 8/1983 | Nishimura et al. | 355/4 |
| 4,416,533 | 11/1983 | Tokunaga et al. | 355/4 |
| 4,599,285 | 7/1986 | Haneda et al. | 355/4 Y |
| 4,611,901 | 9/1986 | Kohyama et al. | 355/4 |

FOREIGN PATENT DOCUMENTS

| | | | |
|---|---|---|---|
| 61-162070 | 7/1986 | Japan | 355/3 DD |

*Primary Examiner*—Arthur T. Grimley
*Assistant Examiner*—J. Pendegrass
*Attorney, Agent, or Firm*—Foley & Lardner, Schwartz, Jeffery, Schwaab, Mack, Blumenthal & Evans

[57] ABSTRACT

In a developing system, a first latent image is formed on a photoconductive drum which is rotated in a direction and is developed by a black toner fed from a first developer. A second latent image is also formed on a rotated photoconductive drum and is also developed by a chromatic toner fed from a second developer. The first and second developers are arranged around the rotated photoconductive drum and are rotated in a direction opposite to the rotated direction of the photoconductive drum. The first developer is rotated at a predetermined peripheral velocity higher than that of the drum and the second developer is rotated at a predetermined peripheral velocity equal to that of the drum.

15 Claims, 6 Drawing Sheets

DEVELOPING APPARATUS FOR APPLYING DIFFERENT COLOR TONERS

BACKGROUND OF THE INVENTION

The present invention relates to a recording system capable of multi-color recording of data and, more particularly, to a developing apparatus for a recording system, capable of multi-color recording of an electrostatic latent image.

A developing apparatus of a conventional recording system which can record data in two colors, e.g., black and one chromatic color comprises drum-like photoconductive member 1 as a recording medium on which an electrostatic latent image is formed, as shown in FIG. 1. First charger 3, first exposure unit 4, first developing unit 5, second charger 6, second exposure unit 7, and second developing unit 8 are arranged along rotating direction 2 of photoconductive member 1. Pre-transfer charger 9, transfer charger 10, separation charger 11, cleaner 12, and eraser lamp 13 are sequentially arranged on the downstream side of second developing unit 8. In this developing apparatus, after photoconductive member 1 is uniformly charged by first charger 3, a first electrostatic latent image is formed on photoconductive member 1 by first exposure unit 4, and the latent image is visualized in a first color by first developing unit 5. Then, after photoconductive member 1 is uniformly charged by second charger 6, a second electrostatic latent image is formed by second exposure unit 7, and the latent image is visualized in a second color by second developing unit 8. As the first developed toner is charged by second charger and the second developed toner isn't charged, there is a different of transfer condition between two toners. So photoconductive member is charged by pre-transfer charger 9. After precharging, two color images is transferred onto paper sheet 14 by transfer charger 10. Then, paper sheet 14 is peeled from photoconductive member 1 by separation charger 11, and is then guided toward a fixer (not shown). After the transfer operation, residual toner remaining on photoconductive member 1 is cleaned by cleaner 12. Finally, the latent image on photoconductive member 1 is erased by eraser lamp 13. In this manner, one cycle is ended.

In general, first developing unit 5 is used for black-color printing most frequently in a multicolor printing mode, and second developing unit 8 is used for printing in another chromatic color. In each of developing units 5 and 8, a developing roller as a developing agent carrier opposes photoconductive member 1 in a non-contact manner. The developing roller is rotated at the same peripheral velocity as that of photoconductive member 1, and the latent image on photoconductive member 1 is developed by toner fed from the developing roller.

However, in two-color developing processes described above, a developing state of first developer 5 located at the upstream side along the moving direction of photoconductive member 1 is insufficient, that is, the density of a line image is sufficient but the image density of a solid portion is insufficient. Thus, multi-color printing with high quality cannot be performed.

SUMMARY OF THE INVENTION

It is an object of the present invention to provide a developing apparatus capable of reproducing a multicolor image with high quality.

According to the present invention, a recording system comprises rotation means, rotated in a predetermined direction at a constant peripheral velocity and including a recording medium provided on a surface thereof; first charging means for charging the recording medium of the rotation means; first electrostatic latent image forming means for forming a first electrostatic latent image on the surface of the recording medium of the rotation means which is charged by the first charging means; first developing means for carrying a first developing agent, and applying the first developing agent to the surface of the recording medium on which the first latent image is formed, thereby developing the first latent image, the first developing means having a surface opposite to the recording medium to have a gap between itself and the recording medium, and being rotated in a direction opposite to the predetermined direction of the rotation means, so that opposing surfaces are moved in the same direction, and the first developing means being rotated at a predetermined peripheral velocity higher than that of the rotation means; second charging means for charging the recording medium of the rotation means developed by the first developing agent; second electrostatic latent image forming means for forming a second electrostatic latent image on the surface of the recording medium which is charged by the second charging means; and second developing means for carrying a second developing agent and applying the second developing agent to the surface of the recording medium on which the second latent image is formed, thereby developing the second latent image, the second developing means having a surface opposite to the recording medium to have a gap between itself and the recording medium, and being rotated in a direction opposite to the predetermined direction of the rotation means, so that opposing surfaces are moved in the same direction, and the second developing means being rotated at a predetermined peripheral velocity substantially equal to that of the rotation means.

DETAILED DESCRIPTION OF THE PREFERRED EMBODIMENT

Figure 1:
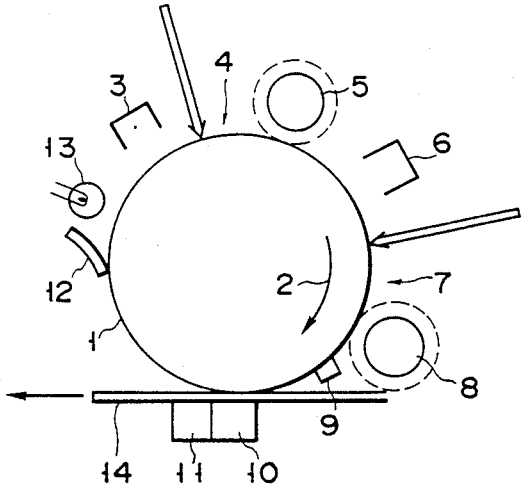
PRIOR ART FIG. 1
FIG. 1 is a schematic view showing a developing process of a conventional two-color printer.
Figure 2:
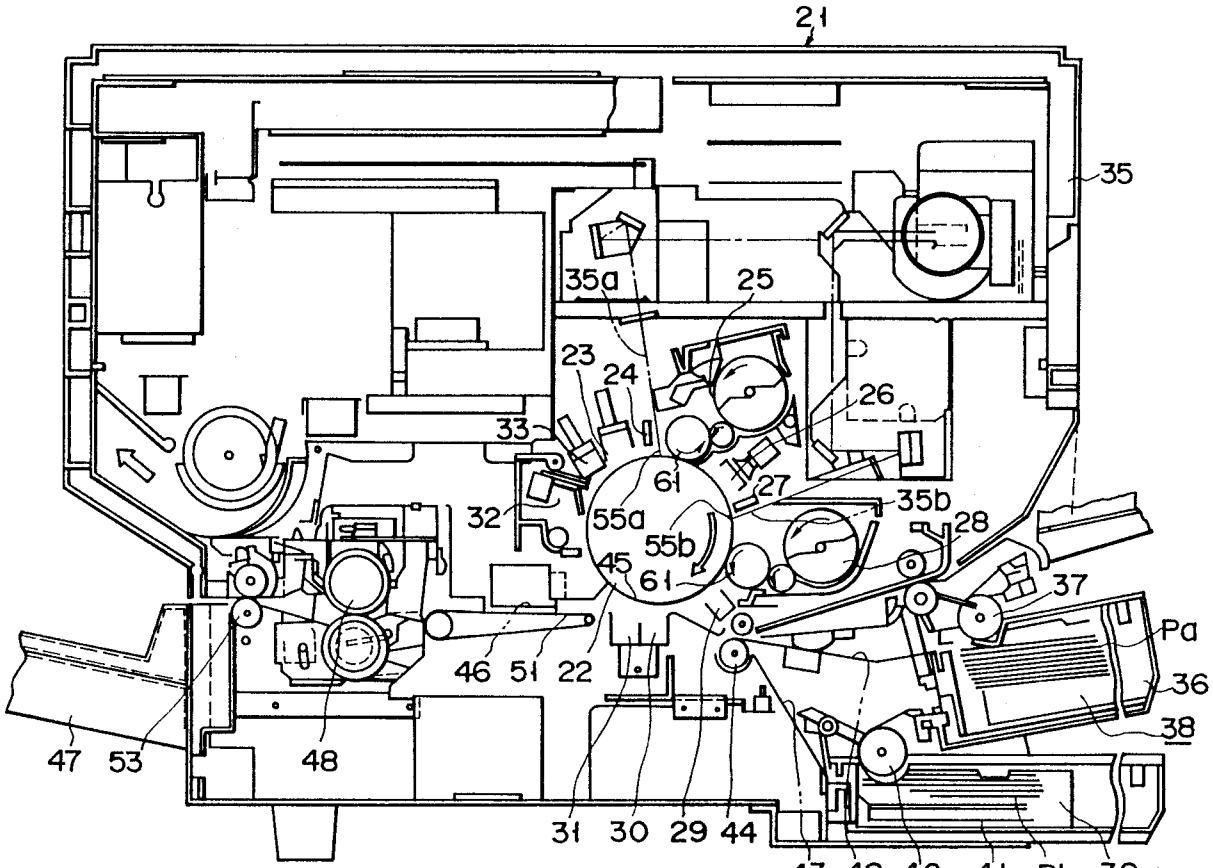
FIG. 2 is a side sectional view schematically showing a laser beam printer incorporating a two-color developing apparatus according to an embodiment of the present invention.

FIG. 2 shows the arrangement of a two-color laser beam printer to which an embodiment of the present invention is applied.

Referring to FIG. 2, reference numeral 21 denotes a printer housing. Drum-like photoconductive drum 22 is arranged at the central portion of printer housing 21. First charging unit 23, first surface potential sensor 24, first developing unit 25 as a developing means, second charging unit 26, second surface potential sensor 27, second developing unit 28, pre-transfer charger 29, transfer charger 30, separation charger 31, cleaner 32, and eraser lamp 33 are arranged around photoconductive drum 22 along the rotating direction of member 1 indicated by the arrow.

Polygonal scanner unit 35 is arranged in the upper right space inside printer housing 21. Unit 35 has an optical system for defining exposure optical paths 35*a* and 35*b* respectively between first surface potential sensor 24 and first developing unit 25 and between second surface potential sensor 26 and second developing unit 28.

Upper paper feed unit 38 consisting of paper feed cassette 36 and paper feed roller 47 and lower paper feed unit 41 consisting of paper feed cassette 39 and paper feed roller 40 are loaded in the lower right space of printer housing 21. When paper feed roller 37 or 40 is selectively rotated, paper sheet Pa or Pb as a transfer medium can be selectively fed.

Paper sheet Pa or Pb fed from paper feed unit 38 or 41 is fed to a pair of register rollers 44 through paper feed paths 42 and 43, and is temporarily stopped thereby. Thereafter, paper sheet Pa or Pb i fed by register rollers 44 into image transfer portion 45 defined between transfer charger 30 and photoconductive member 32 in synchronism with the rotation of photoconductive drum 22.

Paper sheet Pa or Pb which is fed into image transfer portion 45 and on which an image is transferred is fed along paper convey path 46 by attraction conveyor belt 51, and is then discharged onto tray 47 arranged on the left side of printer housing 21 through fixer 48 and a pair of discharge rollers 53. In this case, the paper sheet is subjected to a fixing operation by fixer 48 midway along the convey path.

In the laser beam printer described above, data is reproduced by the following process, and an image is formed on a paper sheet.

Photoconductive drum 22 is rotated and is charged by first charger 23. Charged photoconductive drum 22 is scanned and exposed with first laser beam 55*a* which is emitted from polygonal scanner unit 35 and is deflected toward drum 22 through optical path 35*a*. Therefore, on the surface of photoconductive drum 22, only a data area is maintained at a low potential to form an electrostatic latent image, and an area other than the data area is maintained at a high potential. The latent image is visualized by positively charged black toner fed from first developing unit 25.

Then, photoconductive drum 22 is again charged by second charger 26. Charger 26 may employ a scorotron charger. The surface potential set on photoconductive drum 22 by first exposure is uniformed by the scorotron charger.

In this manner, photoconductive drum 22 having a substantially uniform surface potential is scanned and exposed with second laser beam 55*b* which is emitted from polygonal scanner unit 35 and is deflected toward photoconductive drum 22 through optical path 35*b*. Therefore, similarly, on the surface of photoconductive drum 22, only a data area is maintained at a low potential to form an electrostatic latent image, and an area other than the data area is maintained at a high potential. The latent image is visualized by positively charged color toner, e.g., red toner fed from second developing unit 28.

With the above process, a two-color image is formed on photoconductive drum 22, and transfer conditions of the two toner images on drum 22 are prepared by pre-transfer charger 29. Then, the two-color image is transferred to paper sheet Pa or Pb as a transfer medium by transfer charger 20. Thereafter, paper sheet Pa or Pb is peeled from photoconductive drum 22 by peeling charger 31, and is subjected to the fixing operation by fixer 48. Sheet Pa or Pb is discharged onto tray 27.

Toner remaining on photoconductive drum 22 without being transferred is cleaned by cleaner 12 upon rotation of drum 22. Photoconductive drum 22 is discharged by discharger 23 to be a clean state. Then, photoconductive drum 22 is ready for the next print cycle.

The two-color image formation process has been described. Developing units 25 and 28 will be described hereinafter in detail.

Figure 3:
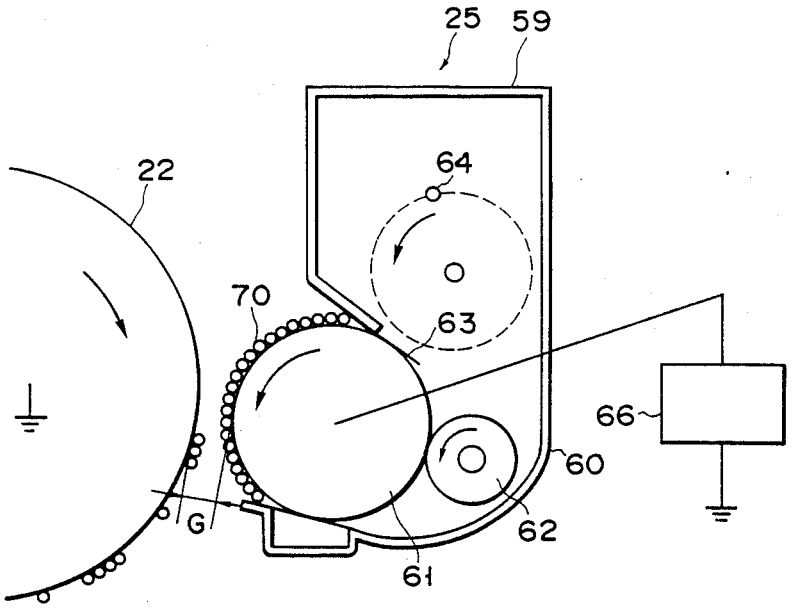
FIG. 3 is a side view schematically showing a first developer shown in FIG. 2.
Figure 4:
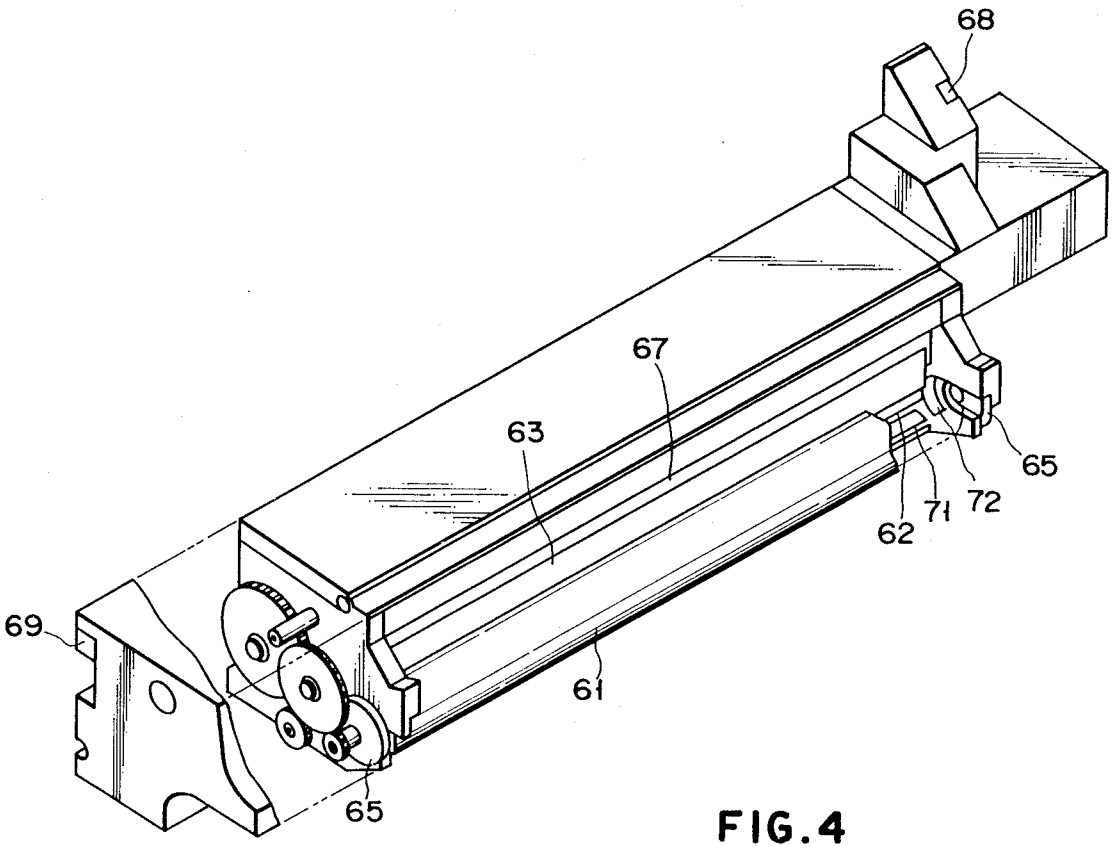
FIG. 4 is a perspective view showing the first developer shown in FIG. 3.

FIG. 3 shows a schematic sectional structure of first developing unit 25, and FIG. 4 shows its outer appearance.

Developing unit 25 comprises toner box 59 storing, as a developing agent, non-magnetic one-component toner without using a carrier. In developer body 60 integrally formed with toner box 59, developing sleeve 61 for carrying a developing agent, i.e., toner, feed roller 62 for feeding developing toner, and coating plate 63 for coating the toner onto sleeve 61 are housed. In addition, stirring member 64 is housed in toner box 59. Note that in FIG. 4, reference numeral 67 denotes a holder; 68, an indicator for indicating a color of toner; 69, a detector for detecting a color of toner; 71, a blade for recovering toner; and 72, a side seal.

Developing sleeve 61 comprises a hollow stainless steel pipe, the surface roughness of which is set to be 1 to 3 μm in Rz indication by a surface treatment. Gap G between developing sleeve 61 and photoconductive drum 22 is set to be 250 μm by gap adjusting rings 65.

Developing bias generator 66 for outputting an AC voltage superposed on a DC component is connected to developing sleeve 61. A varying electrical field consisting of a static electrical field and an alternate electrical field is produced between developing sleeve 61 and photoconductive drum 22.

The non-magnetic one-component toner in toner box 59 is stirred by stirring member 64, and is coated on sleeve 63 by coating plate 63 formed of a thin elastic metal plate so as to form thin toner layer 70 on sleeve 61. Upon rotation of sleeve 61, toner layer 70 is moved to a developing region. In the developing region, the toner is transferred onto photoconductive drum 22 by the electrical field, and the latent image formed on drum 22 is developed thereby.

The present inventors examined the developing state of the latent image on photoconductive drum 22 developed by first developing unit 25, and made the following findings.

Figure 5:
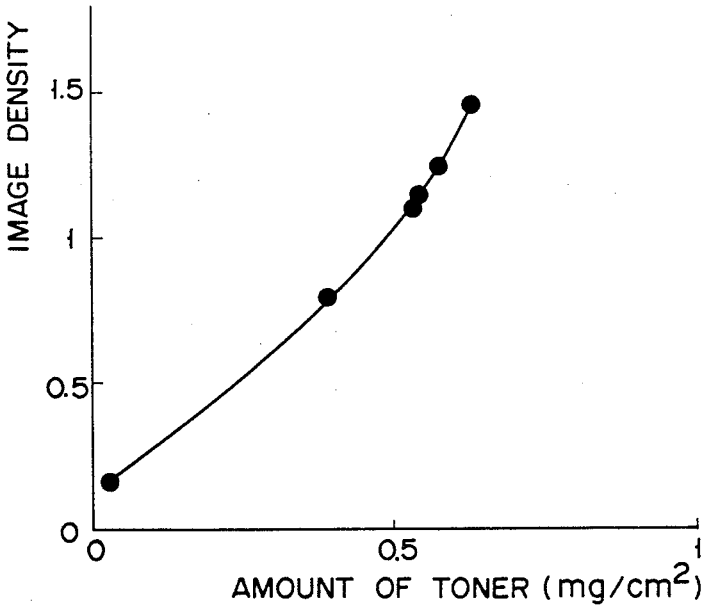
FIG. 5 is a graph showing the relationship between image density and amount of toner.

First, the relationship between an image density and an amount of toner when developing sleeve 61 and photoconductive drum 22 are rotated in opposite directions at the same velocity was examined, and the relationship shown in FIG. 5 was obtained. It was found from FIG. 5 that in order to obtain an image density of 1.2 that is normally regarded as a sufficient image density at a solid portion, 0.57 mg/cm$^2$ of toner per unit area of sleeve 61 must be applied to sleeve 61.

Figure 6:
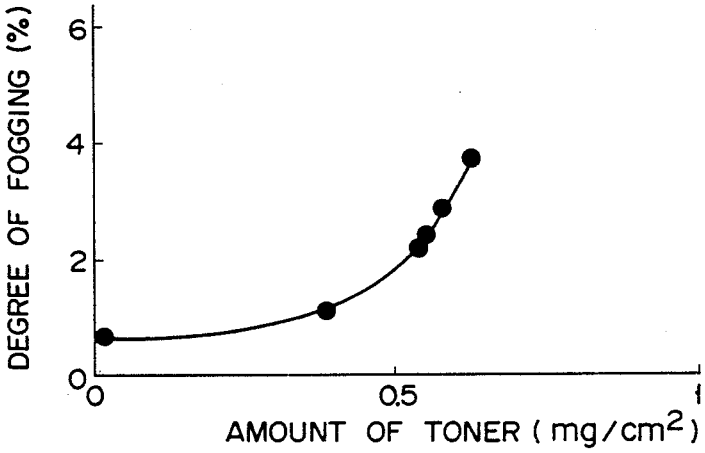
FIG. 6 is a graph showing the relationship between fogging and amount of toner.

The relationship between an amount of toner and fogging occurring on the photoconductive member was examined using a similar developing apparatus, and the results shown in FIG. 6 were obtained. As can be apparent from the graph of FIG. 6, in order to reduce fogging to 1.0% or less, 0.4 mg/cm$^2$ or less of toner can only be applied to sleeve 61.

It was found from the graphs shown in FIGS. 5 and 6 that it is difficult for a conventional developing apparatus to obtain an image density of 1.2 or more and to reduce fogging to 1.0% or less.

The present inventors examined the relationship between a ratio of the peripheral velocities and the image density while changing the ratio of the peripheral velocity of developing sleeve 61 to that of photoconductive drum 22 to be 0.8:1, 1:1, 1.2:1, and 1.5:1. In this case, the peripheral velocity of photoconductive drum 22 was left unchanged, and only the peripheral velocity of developing sleeve 61 was changed. Photoconductive drum 22 was rotated clockwise, and developing sleeve 61 was rotated counterclockwise, so that the opposing regions were moved in the same direction. 0.4 mg/cm$^2$ of toner was applied onto developing sleeve 61 so as to reduce fogging to 1.0% or less. As a result of this test, the graph shown in FIG. 7 could be obtained.

Figure 7:
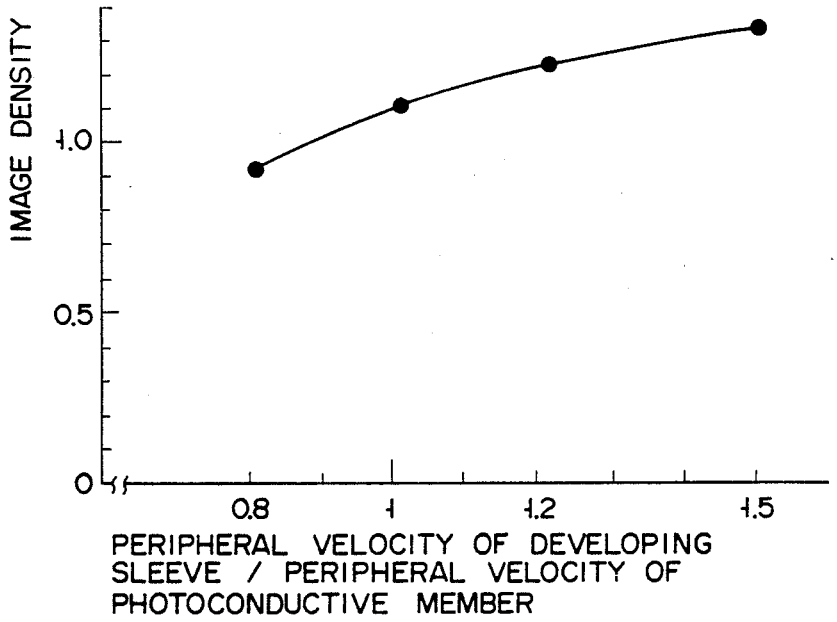
FIG. 7 is a graph showing the relationship between an image density and a ratio of peripheral velocity of a developing sleeve with respect to that of a photoconductive member.

As can be seen from the graph shown in FIG. 7, when the peripheral velocity of developing sleeve 61 is higher than that of photoconductive drum 22, the image density can be increased. In this case, no fogging was observed, and reproducibility of fine lines was good, resulting in good printing quality.

Second developing unit 28 was also tested following the same procedures as above. Since second developing unit 28 has the same structure as that of first developing unit 25, a detailed description thereof will be omitted. However, in second developing unit 28, a DC voltage consisting of only a DC component was applied across photoconductive drum 22 and developing sleeve 61, thus forming a static electric field therebetween. This is because a developing bias including an AC component disturbs the toner developed by first developing unit 25.

The print test was conducted for second developing unit 28 while changing the peripheral velocity of developing sleeve 61 following the same procedures as for first developing unit 25. A uniform density could not be obtained except for the ratio of peripheral velocities of 1:1, and a normal printing state could not be obtained. In this case, sleeve 61 and photoconductive drum 22 were rotated in the opposing directions.

Based on the findings of the above tests, the peripheral velocity of developing sleeve 61 of first developer 25 was set to be 1.5 times that of photoconductive drum 22, the peripheral velocity of developing sleeve 61 of second developing unit 28 was set to be equal to that of photoconductive drum 22, and developing sleeves 61 were rotated in the same direction, and a two-color print test was conducted. A good two-color image with sufficient image density and resolution in both black and color image portions developed by first and second developing units 25 and 28 could be obtained.

In the above embodiment, the system for two-color printing has been exemplified. The present invention is not limited to this. When the numbers of charging means, latent image forming means, and developing means are increased, a printing operation for two colors or more can be performed.

According to the present invention as described above, a recording system which can obtain a multicolor image with good print quality can be obtained without modifying a basic structure.

What is claimed is:

1. A developing system comprising:

rotation means, rotated in a predetermined direction at a constant peripheral velocity and including a recording medium provided on a surface thereof;

first charging means for charging said recording medium;

first electrostatic latent image forming means for forming a first electrostatic latent image on the surface of said recording medium which is charged by said first charging means;

first developing means for carrying a first developing agent, and applying the first developing agent to the surface of said recording medium on which the first latent image is formed, thereby developing the first latent image, said first developing means having a surface opposite to said recording medium to have a gap between itself and said recording medium, and being rotated in a direction opposite to the predetermined direction of said rotation means, so that opposing surfaces are moved in the same direction, and said first developing means being rotated at a predetermined peripheral velocity higher than that of said rotation means;

second charging means for charging said recording medium of said rotation means developed by the first developing agent;

second electrostatic latent image forming means for forming a second electrostatic latent image on the surface of said recording medium which is charged by said second charging means; and second developing means for carrying a second developing agent and applying the second developing agent to the surface of said recording medium on which the second latent image is formed, thereby developing the second latent image, said second developing means having a surface opposite to said recording medium to have a gap between itself and said recording medium, and being rotated in a direction opposite to the predetermined direction of said rotation means, so that opposing surfaces are moved in the same direction, and said second developing means being rotated at a predetermined peripheral velocity substantially equal to that of said rotation means.

2. A system according to claim 1, wherein the first developing agent is a black developing agent, and the second developing agent is a chromatic color developing agent.

3. A system according to claim 1, further including means for applying about 0.4 mg/cm$^2$ of the developing agent to each of the surfaces of said first and second developing means.

4. A system according to claim 1, wherein said first developing means is rotated at a peripheral velocity substantially 1.5 times that of said rotation means.

5. A system according to claim 1, further comprising:

means for transferring an image developed by said first and second developing means to a paper sheet.

6. An apparatus for developing an electrostatic latent image on a rotatable image carrier, comprising:

a first rotatable member for carrying a toner thereon and applying the toner to the electrostatic latent image, said first rotatable member facing the rotatable image carrier with a gap and being rotated in a direction opposite to the rotational direction of the rotatable image carrier and at a peripheral speed higher than that of the rotatable image carrier; and a second rotatable member for carrying a toner thereon and applying the toner to the electrostatic latent image, said second rotatable member facing the rotatable image carrier with a gap and being rotated in a direction opposite to the rotational direction of the rotatable image carrier and at a peripheral speed substantially equal to that of the rotatable image carrier; and said second rotatable member facing the rotatable image carrier after the application of the toner to the electrostatic latent image by said first rotatable member so as to cause the toner carried on said second rotatable member to deposit on the electrostatic latent image overlappingly.

7. The apparatus of claim 6 in which said toner applied to said first rotatable member is a black developing agent and the toner applied to said second rotatable member is a chromatic color developing agent.

8. The apparatus of claim 6 further including first application means for applying an AC voltage biased by a DC voltage across said first rotatable member and said rotatable image carrier; and second application means for applying a DC voltage across and second rotatable member and second rotatable image carrier.

9. The apparatus of claim 6 wherein said toner is applied to the surfaces of said first and second rotatable members in the amount of about 0.4 mg/cm$^2$.

10. The apparatus of claim 6 wherein said first rotatable member is rotated at a peripheral velocity substantially 1.5 times that of said rotatable image carrier.

11. A developing system comprising:

rotation means, said means rotating in a predetermined direction at a constant peripheral velocity, and including a recording medium on the surface thereof;

first charging means for charging said recording medium;

first electrostatic latent image forming means for forming a first electrostatic latent image on the surface of said recording medium which is charged by said first charging means;

first developing means for carrying out a first developing agent and applying said first developing agent to the surface of said first recording medium on which the first latent image is formed, thereby developing the first latent image, said first developing means having a surface opposite said recording medium to form a gap therebetween, and being rotated in a direction opposite to the predetermined direction of said rotating means, so that opposing surfaces move in the same direction, said first developing means being rotated at a predetermined peripheral velocity higher than that of said rotation means;

second charging means for charging said recording medium of said rotation means developed by the first developing agent;

second electrostatic latent image forming means forming a second electrostatic latent image on the surface of said recording medium which is charged by said second charging means;

second developing means for carrying a second developing agent and applying the second developing agent to the surface of said recording medium on which the second latent image is formed, thereby developing the second latent image, said second developing means having a surface opposite to said recording medium to form a gap therebetween, and being rotated in a direction opposite to the predetermined direction of said rotation means, so that opposing surfaces are moved in the same direction, said second developing means being rotated at a predetermined peripheral velocity substantially equal to that of said rotation means;

first application means for applying an AC voltage biased by a DC voltage across said first developing means and said recording medium; and second application means for applying a DC voltage across said second developing means and said rotation means.

12. The developing system of claim 11 wherein the first developing agent is a black developing agent and the second developing agent is a chromatic color developing agent.

13. The developing system of claim 11 in which developing agent is applied to said first and second developing means at a rate of about 0.4 mg/cm$^2$.

14. The developing system according to claim 11 wherein said first developing means is rotated at a peripheral velocity substantially 1.5 times that of said rotation means.

15. The developing means system of claim 11, further including means for transferring an image developed by said first and second developing means to a paper sheet.

* * * * *